US006119773A

United States Patent [19]

Gariepy et al.

[11] Patent Number: 6,119,773

[45] **Date of Patent: *Sep. 19, 2000**

[54] WELL PRODUCTION SYSTEM WITH A HYDRAULICALLY OPERATED SAFETY VALVE

[75] Inventors: James A. Gariepy, Houston, Tex.; Norman Brammer, Aberdeen, United Kingdom; Brett R. McConaughy, Ho Chi Minh, Viet Nam

[73] Assignee: ABB Vetco Gray Inc., Houston, Tex.

[ * ] Notice: This patent is subject to a terminal disclaimer.

[21] Appl. No.: 08/903,037

[22] Filed: Jul. 29, 1997

(Under 37 CFR 1.47)

Related U.S. Application Data

[63] Continuation of application No. 08/561,499, Nov. 20, 1995, Pat. No. 5,865,250, which is a continuation-in-part of application No. 08/470,104, Jun. 6, 1995, Pat. No. 5,555,935, which is a continuation-in-part of application No. 08/294,679, Aug. 23, 1994, Pat. No. 5,465,794.

[51] Int. Cl.[7] ..... E21B 34/10

[52] U.S. Cl. ..... 166/88.1; 166/375

[58] Field of Search ..... 166/374, 375, 166/88.1

[56] References Cited

U.S. PATENT DOCUMENTS 5,465,794 11/1995 McConaughy et al. ..... 166/375
5,555,935 9/1996 Brammer et al. ..... 166/88.1

*Primary Examiner*—George Suchfield
*Attorney, Agent, or Firm*—Felsman, Bradley, Vaden, Gunter & Dillon, LLP; James E. Bradley

[57] ABSTRACT

A tubular wellhead member has an inner seal surface. A hydraulic passage extends through the wellhead member and terminates at a port at the seal surface. A tubing hanger having an outer mating surface lands in the wellhead member. A hydraulic line extends from a hydraulically operated downhole safety valve to a passage in the tubing hanger and terminates at a tubing hanger port. A seal is located at the tubing hanger port for sealing the junction with the tubular member port. A check valve is located within the seal to maintain the tubing hanger fluid passage closed until the tubing hanger lands in the wellhead. An adapter is employed to apply a running-in hydraulic fluid pressure to the tubing hanger hydraulic fluid passage with the check valve open. Then, the adapter closes the check valve to trap hydraulic fluid pressure in the line leading to the downhole safety valve. This pressure is sufficient to maintain the downhole safety valve in an open position during running in.

14 Claims, 4 Drawing Sheets

WELL PRODUCTION SYSTEM WITH A HYDRAULICALLY OPERATED SAFETY VALVE

CROSS REFERENCE TO RELATED APPLICATIONS

This is a continuation of the application Ser. No. 08/561,499 filed Nov. 20, 1995, now U.S. Pat. No. 5,865,250, which is a Continuation-In-Part of application Ser. No. 08/470,104, filed on Jun. 6, 1995, which matured into U.S. Pat. No. 5,555,935, issued Sep. 17, 1996, which is a Continuation-In-Part of application Ser. No. 08/294,679, filed Aug. 23, 1994, which matured into U.S. Pat. No. 5,465,794, issued Nov. 14, 1995.

BACKGROUND OF THE INVENTION

1. Field of the Invention

This invention relates in general to well production systems, and in particular to a hydraulic seal and check valve between a tubing hanger and a wellhead member for providing hydraulic fluid to a hydraulically operated safety valve.

2. Description of the Prior Art

Downhole safety valves are often used in well production systems. These downhole safety valves are connected into the production tubing string and are designed to shut-off flow through the production tubing string in the case of a malfunction so as to avoid a blowout. Most downhole safety valves are hydraulically operated. Hydraulic pressure maintains the valve in the open position. Removal or interruption of the hydraulic pressure causes the safety valve to shut-off flow through the production tubing string.

A hydraulic line extends to the downhole safety valve from the surface to provide the safety valve with hydraulic fluid pressure. The hydraulic fluid line extends alongside the production tubing string. There are different techniques for connecting the hydraulic fluid line to the exterior of the wellhead or tree. In one type, the wellhead has an annular seal surface in its bore. The tubing hanger has a mating surface which mates with the annular seal surface. A number of hydraulic passages extend through the wellhead and terminate at the seal surface in the bore for supplying hydraulic fluid for various purposes. Similarly, the tubing hanger has a number of hydraulic passages terminating at the mating surface. Seals are located at each of the ports to seal the interface when the tubing hanger lands.

When running the tubing and tubing hanger into the well, it is important to keep the hydraulic passages free of any debris. This can be a problem in the case of a subsea well where the tubing hanger is lowered through a riser in deep water. Also, when running the tubing string, it is necessary to keep the downhole safety valve in an open position, allowing well fluid to flow up the tubing. Otherwise, a pressure differential will exist above the downhole safety valve due to hydrostatic fluid in the well. This differential could cause the tubing to collapse.

In the prior art, the downhole safety valve is held in an open position by a mechanical sleeve that is placed in the valve as the valve is installed in the tubing string. After the tubing hanger has landed in the wellhead, the operator runs a retrieval tool through the tubing string on a wire line to latch into the sleeve and retrieve it, allowing the downhole safety valve to close. While this works well in most occasions, a possibility It exists that the sleeve will stick and require the tubing to be pulled for removal of the sleeve.

SUMMARY OF THE INVENTION

In this invention, the tubing hanger has one or more ports at a mating surface for registering with wellhead ports. Seals are located at the tubing hanger ports to interface with the wellhead seal surface. A check valve is carried in each of the insert member ports. The check valve is biased to a closed position which closes the insert member port. This prevents the entry of debris into the hydraulic passage. The check valve has a plunger which engages the seal surface in the bore as the insert member lands in the bore and which moves the check valve to an open position. The check valve is encircled by the seal and protrudes slightly beyond the face of seal prior to landing of the tubing hanger in the wellhead.

Hydraulic fluid pressure is maintained at the downhole safety valve while the tubing is being run to keep the downhole safety valve in an open position. The hydraulic fluid pressure is introduced by securing an adapter to the check valve.

Hydraulic fluid pressure passes through the check valve and into the hydraulic fluid pressure line leading to the downhole safety valve. Then, the check valve is moved to the closed position, trapping the hydraulic fluid pressure in the line leading to the downhole safety valve.

The check valve is moved to the closed position by use of a piston located within a chamber in the adapter. The piston divides the chamber into an inner portion and an outer portion. In one method of operation, the operator supplies pressure to the inner portion at a test level sufficient to open the check valve and the safety valve and to test the seals of the hydraulic circuit. The operator then supplies pressure to the outer portion at the same or greater level. Then the operator reduces the pressure in the inner chamber portion to a level less than the bias force of the check valve spring, but sufficient to keep the downhole safety valve open. The pressure differential moves the piston forward into contact with the check valve, keeping it open. The operator then removes the pressure in the outer portion, causing the piston to retract under the force of the bias spring in the check valve. The check valve closes, trapping pressure in the hydraulic line leading to the downhole safety valve.

DETAILED DESCRIPTION OF THE PREFERRED EMBODIMENT

Figure 1:
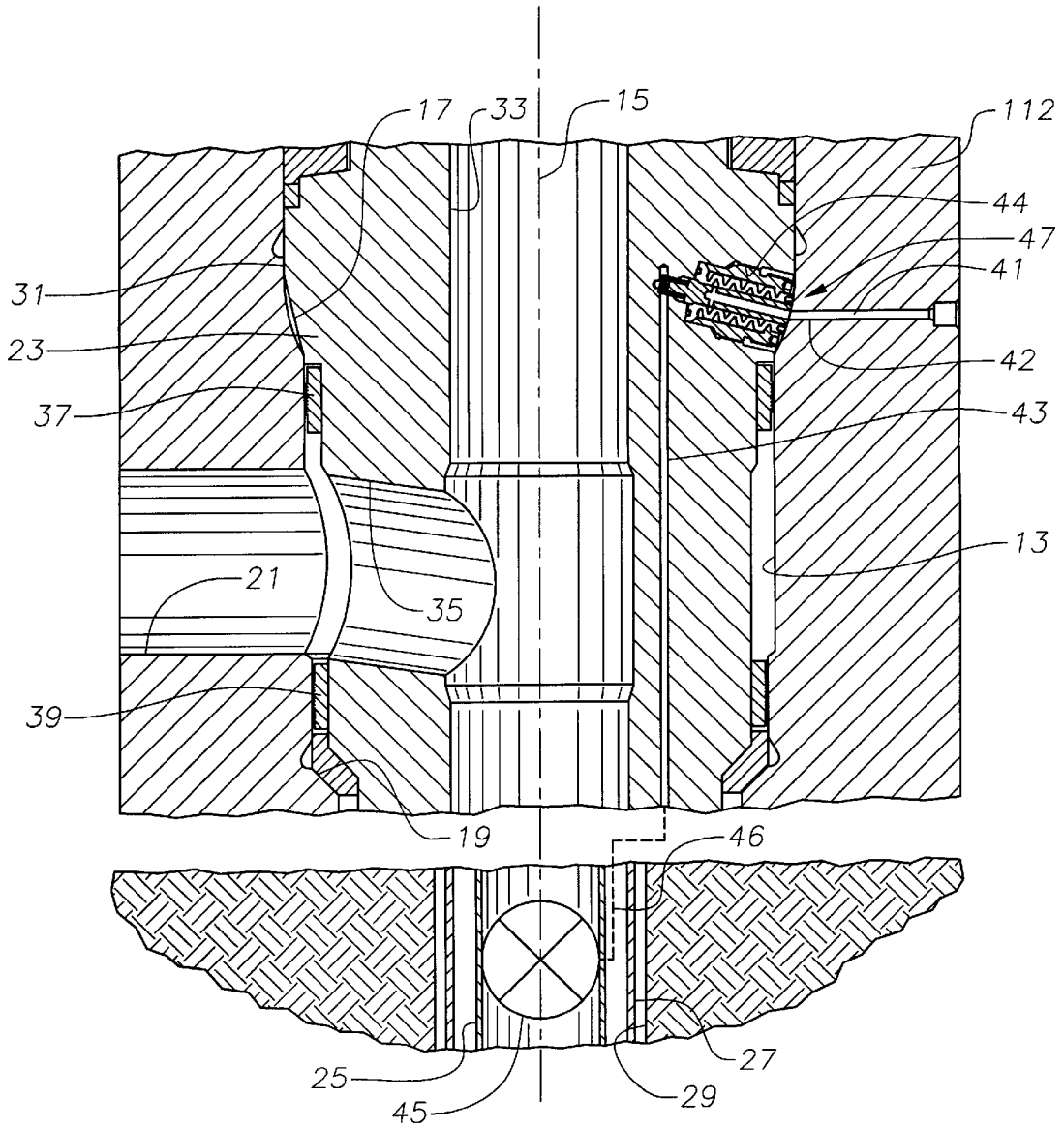
FIG. 1 is a vertical sectional view illustrating a wellhead and a schematically shown downhole safety valve, the hydraulic passage to the downhole safety valve having a check valve constructed in accordance with this invention.

Referring to FIG. 1, wellhead or tree 11 is of a type that may be used subsea. Wellhead 11 is mounted to the upper end of a wellhead housing (not shown) and has an axial bore 13 that extends along a longitudinal axis 15. An annular seal surface 17 is formed in bore 13. In the preferred embodiment, seal surface 17 is concave and a portion of a sphere, having a lesser diameter on its lower edge than on its upper edge. A landing shoulder 19, which is a conical surface, is located below seal surface 17. In the embodiment shown, a production outlet 21 extends laterally through wellhead 11.

A tubing hanger 23 is shown landed on shoulder 19 in wellhead 11. Tubing hanger 23 supports a string of tubing 25 that extends through casing 27 in a wellbore 29. Casing 27 is supported in the wellhead housing, which is located below wellhead 11 and is not shown. Tubing hanger 23 has a mating surface 31 that is closely spaced to the spherical seal surface 17 in bore 13. Tubing hanger 23 has an axial passage 33, which will be closed at its upper end by a plug (not shown). Production fluid flows through a lateral passage 35 into production outlet 21. Annular seals 37, 39 seal above and below the junction of the lateral passages 21, 35. Seals 37, 39 extend circumferentially around tubing hanger 23, perpendicular to axis 15.

A number of hydraulic fluid passages (only one shown) extend through wellhead 11 for supplying hydraulic fluid to various downhole members. Tubing hanger 23 has a number of hydraulic passages 43 (only one shown) which have ports 44 that register with wellhead passages 41. Each wellhead passage 41 has a port 42 at seal surface 17 which registers with one of the tubing hanger ports 44 at mating surface 31. Tubing hanger hydraulic passage 43 leads through tubing hanger 23 to an external line 46 which supplies hydraulic fluid pressure to a downhole safety valve 45, which includes a downhole actuator for opening and closing a valve in tubing 25. Downhole safety valve 45 is a conventional member that is biased by spring to a closed position. When hydraulic fluid pressure at a sufficient level is applied, downhole safety valve 45 will open, allowing flow through tubing 25.

Figure 2:
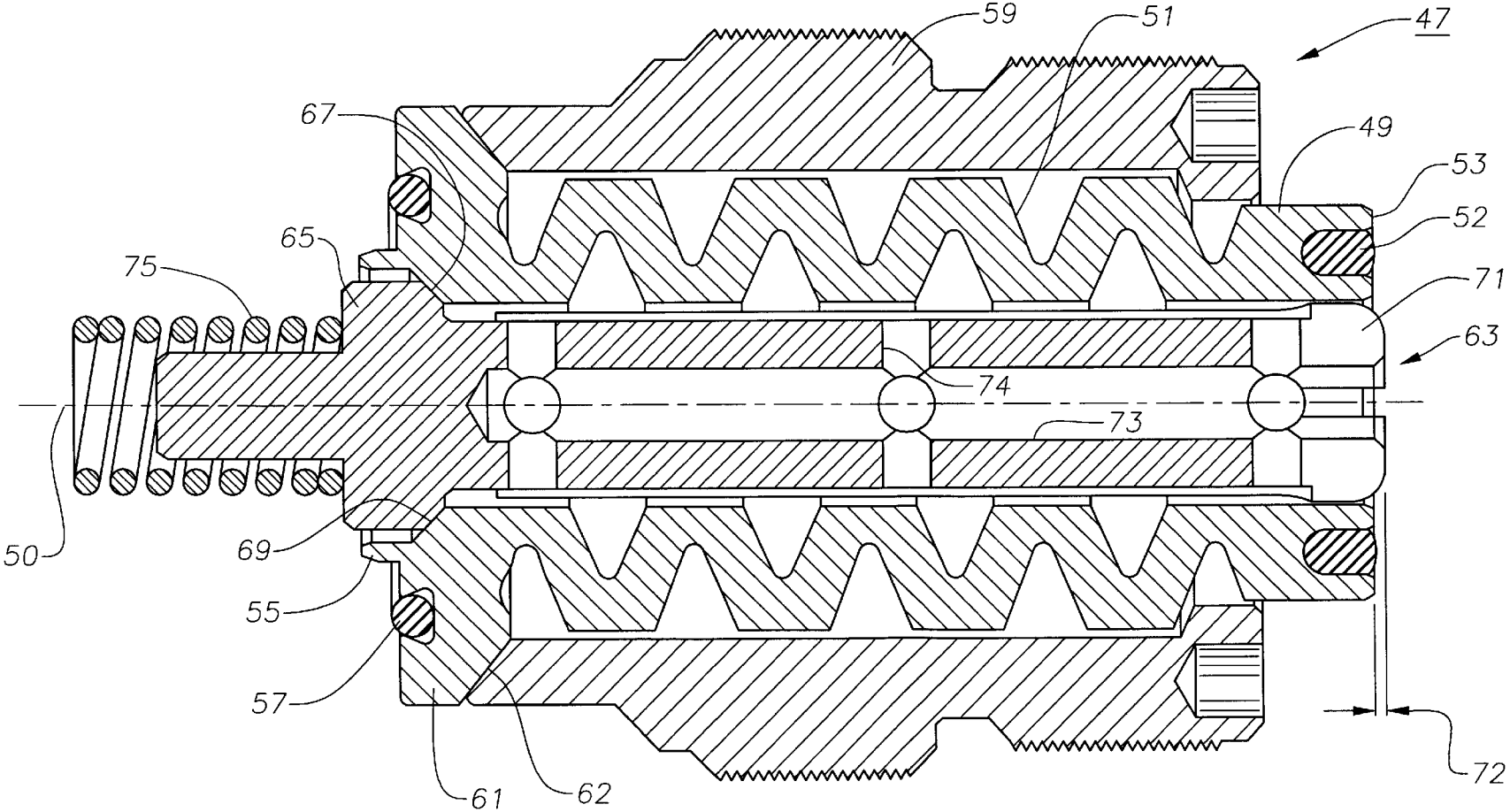
FIG. 2 is an enlarged sectional view of the check valve employed with the wellhead of FIG. 1.

A seal assembly 47 is located in each tubing hanger port 44. Referring to FIG. 2, seal assembly 47 includes a seal sleeve or metal tube 49 which has an axis 50 that is transverse to axis 15 (FIG. 1). Tube 49 has a corrugated wall 51, having large V-shaped corrugations resembling that of a bellows. Corrugated wall 51 is quite stiff, but allows a slight axial deflection along axis 50 when face 53 engages seal surface 17 (FIG. 1). Face 53 has an overlay of soft metal 0.060 to 0.090 inches thick for sealing against seal surface 17. A groove is formed in face 53 for receiving an elastomeric seal 52 which serves as a backup for the metal seal of face 53. The perferred overlay material for face 53 is stainless steel having a yield strength of 45,000 to 60,000 psi, while seal surface 17 has a yield strength of 80,000 to 85,000 psi. An elastomeric ring 57 is located on the inner end of seal tube 49 for sealing against a shoulder in tubing hanger 23 (FIG. 1). A cylindrical retainer 59 secures to threads in tubing hanger port 44 (FIG. 1). Retainer 59 abuts against a shoulder 61 formed on the lower end of seal tube 49.

A check valve 63 is carried within seal tube 49. Check valve 63 has a body 65 located inward on axis 50 from seal tube 49. Body 65 has a conical seal surface 67 which faces generally outward. Seal surface 67 engages a conical seat 69 formed on the inner end of seal tube 49. Body 65 is connected to a plunger 71 that extends outward and is integrally formed with body 65 in the embodiment shown. Plunger 71 protrudes a short distance past face 53 prior to the landing of tubing hanger 23. The amount of protrusion is sufficient to move seal surface 67 from seat 69 prior to deflection of seal tube 49 due to contact of seal face 53 with seal surface 17 (FIG. 1). Plunger 71 has an axial passage 73, which terminates at body 65 and has lateral passages 74 for the passage of hydraulic fluid once installed as shown in FIG. 1. A spring 75 urges body 65 and plunger 71 in an outward direction, biasing check valve 63 to a closed position. The dimensions of plunger 71 and the type of spring 75 are selected to create a bias force to close check valve 63. This bias force can be overcome by applying fluid pressure to the outer side of body 65 in an amount sufficient to compress spring 75.

Figure 3:
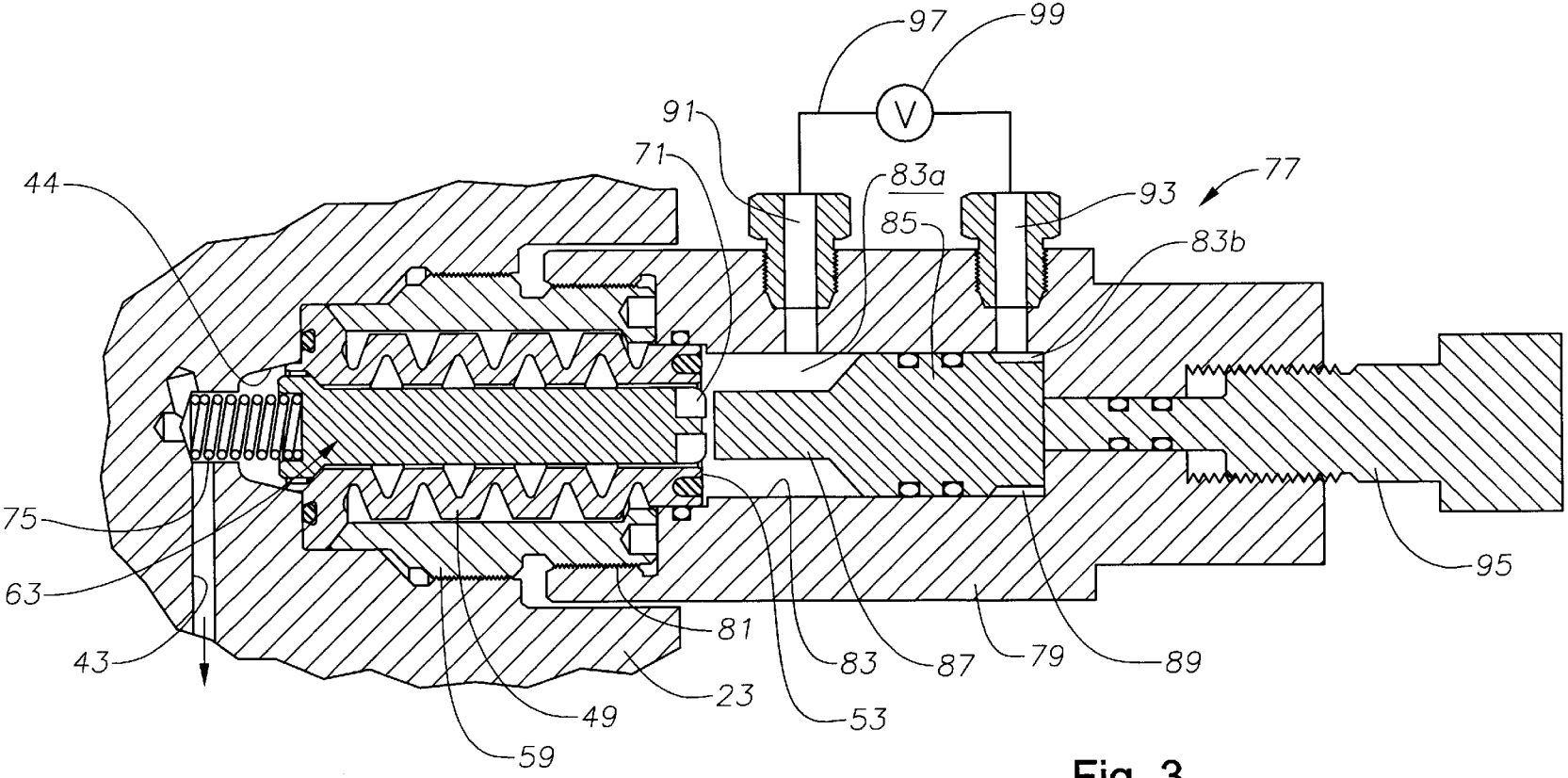
FIG. 3 is a sectional view of the check valve of FIG. 2 and further showing an adapter for applying pressure to the hydraulic line leading to the downhole safety valve.
Figure 4:
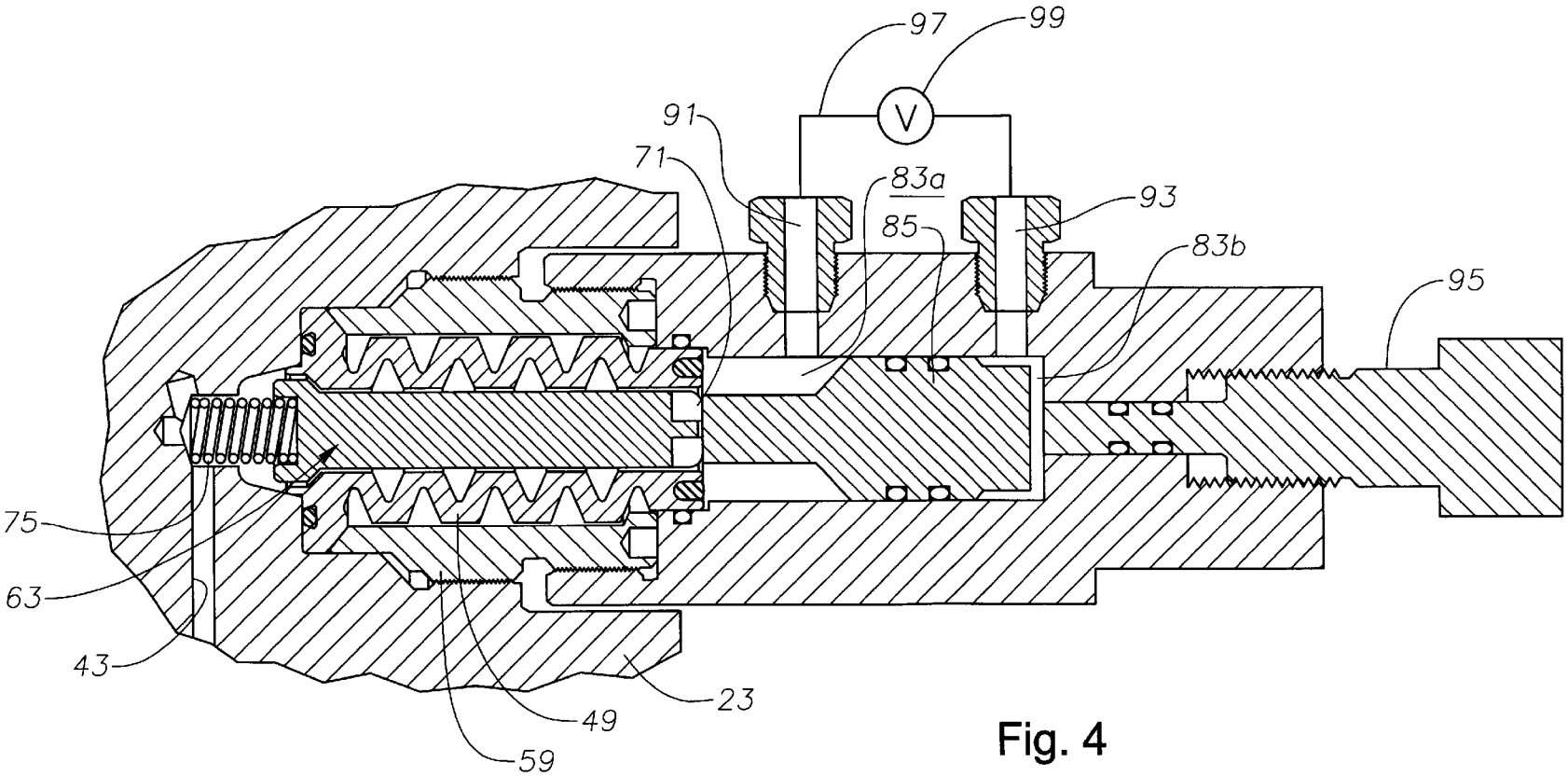
FIG. 4 is a view similar to FIG. 3, but showing the check valve in an open position and hydraulic pressure being applied to the outer side of a piston located in the adapter.

FIGS. 3 and 4 illustrates a means for opening downhole safety valve 45 with hydraulic pressure, then maintaining the hydraulic pressure on downhole safety valve 45 while tubing hanger 23 is being lowered into the wellhead 11. While tubing hanger 23 is still accessible at the surface, the operator will secure an adapter 77 to retainer 59. Adapter 77 has a cylindrical housing 79 with threads 81 that secure to external threads formed on retainer 59. Adapter housing 79 has a chamber which is coaxial with axis 50. A piston 85 in chamber 83 separates chamber 83 into an inner portion 83*a* and an outer portion 83*b*. Piston 85 has an inner neck 87 that protrudes forward for engaging plunger 71, but is dimensioned so as to not contact face 53. Piston 85 has a relieved outer end 89 that is of smaller diameter than chamber outer portion 83*b*.

An inner hydraulic port 91 leads from a source of hydraulic pressure to chamber inner portion 83*a*. An outer hydraulic port 93 leads from a source of hydraulic pressure to outer chamber portion 83*b*, on the opposite side of piston 85. A hydraulic line 97 interconnects inner and outer ports 91, 93. A valve 99 in line 97 selectively opens and closes line 97. A cap screw 95 is secured by threads to housing 79 along axis 50 outward of piston 85. Cap screw 95 may optionally be employed for test purposes to push piston 85 in an inward direction, depressing plunger 71 to open check valve 67. If utilized, cap screw 95 is rotated manually, and would be backed off to the position shown prior to running tubing hanger 23.

Piston 85 hydraulically opens and closes check valve 63. In one method of operation, prior to landing tubing hanger 23 in wellhead 11, the operator supplies hydraulic pressure to inner hydraulic port 91 at a high level for testing the integrity of the downhole safety valve 45, line 46 (FIG. 1), passage 43, and seals 55, 57 and 62. This pressure for example may be 10,000 psi. Valve 99 will be closed, with no pressure being in outer chamber portion 83*b*. The pressure in inner chamber portion 83*a* will overcome the bias of spring 75, opening check valve 63 and downhole safety valve 45.

Once the test is completed, the operator applies equal or greater hydraulic pressure to outer chamber portion 83*b*. This is preferably handled by opening valve 99 in line 97, resulting in equal pressure being applied to opposite sides of piston 85. The operator then closes valve 99 and begins bleeding off the pressure from inner hydraulic port 91. The differential pressure on piston 85 will cause piston 85 to move forward and engage plunger 71 as shown in FIG. 4. Neck 87 of piston 85 will hold check valve 63 in the open position even though the pressure in inner chamber portion 83*a* drops below the amount required to hold check valve 63 open. The operator bleeds off the pressure to a running-in level that is greater than that required to maintain downhole safety valve 45 (FIG. 1) in an open position. For example, depending upon the type of downhole safety valve 45, the pressure could be bled off to slightly more than 200 psi, while the pressure is still being maintained in outer chamber portion 83*b* at 10,000 psi.

Then, once the selected running-in pressure in hydraulic passage 43 is reached, the operator bleeds off the pressure in outer chamber portion 83*b*. As the pressure drops, the force of spring 75 will cause plunger 71 to move outward, closing check valve 63. The differential pressure on piston 85 will move it back to the position shown in FIG. 3. The closure of check valve 63 traps the running-in pressure in tubing hanger hydraulic passage 43. The operator may then bleed off the remaining pressure in inner chamber portion 83 and remove adapter 77.

The operator then proceeds to lower the string of tubing 25 into the well and lands tubing hanger 23 in wellhead 11, as shown in FIG. 1. Plunger 71 will engage seal surface 17, opening check valve 63. Slightly after, seal face 53 will seal against seal surface 17, with some deflection occurring in corrugated sidewall 51. Communication will now be established from wellhead hydraulic passage 41 to downhole safety valve 45, with hydraulic fluid pressure communicating through the passages 73, 74 of the check valve plunger 71 (FIG. 2).

In an alternate method of using adapter 77 as shown in FIGS. 3 and 4, the operator first applies hydraulic pressure to outer hydraulic port 93 while valve 99 is closed. The pressure should be adequate to move piston 85 into engagement with plunger 71 and to compress spring 75, opening check valve 63. Note that there will be no pressure in tubing hanger hydraulic passage 43 at this point, thus, downhole safety valve 45 (FIG. 1) would still be closed.

The operator then applies a running-in level of hydraulic pressure through port 91 to inner chamber portion 83*a*. This running-in pressure communicates through the open check valve 63 to hydraulic passage 43 and is sufficient to open downhole safety valve 45. The operator then removes the pressure in outer chamber portion 83*b*. Spring 75 causes check valve 63 to close, and the pressure differential on piston 85 moves piston 85 back to the outer position shown in FIG. 3. Adapter 77 is then be removed.

The invention has significant advantages. Placing the check valve within the seal avoids entry of foreign matter into the hydraulic passages as the tubing hanger is lowered to a subsea location. An adapter allows the application of a running-in level of hydraulic pressure to the downhole safety valve. This avoids the need for a mechanical sleeve to maintain the downhole safety valve in the open position.

While the invention has been shown in only one of its forms, it should be apparent to those skilled in the art that it is not so limited, but is susceptible to various changes without departing from the scope of the invention.

We claim:

1. A well production assembly comprising in combination:

a production tree having a vertical axis, an axially extending bore, and a lateral production outlet extending from the bore through a sidewall of the tree transverse to the vertical axis;

a tree auxiliary passage extending through the sidewall of the tree and having an auxiliary port in the bore;

a tubing hanger which lands sealingly in the bore and has a lateral flow passage extending from an axial flow passage, the axial flow passage adapted to be connected to a string of tubing, the lateral flow passage aligning with the lateral production outlet of the tree;

a tubing hanger auxiliary passage extending through the tubing hanger, having an auxiliary port which aligns with the auxiliary port in the tree; and a seal at the auxiliary ports which seals the tree auxiliary passage to the tubing hanger auxiliary passage.

2. The well production assembly according to claim 1, wherein each of the auxiliary ports has an axis, and wherein the axes of the auxiliary ports coincide.

3. The well production assembly according to claim 1, wherein the seal comprises:

a tubular seal member located within the auxiliary port of the tubing hanger.

4. The well production assembly according to claim 1, wherein the seal comprises:

a tubular seal member located within the auxiliary port of the tubing hanger; and a seal surface surrounding the auxiliary port of the tree, the seal surface being engaged sealingly by the seal member.

5. The well production assembly according to claim 1, wherein the auxiliary port of the tubing hanger comprises a cylindrical recess; and the seal comprises a tubular member located in the recess.

6. A well production assembly comprising in combination:

a production tree having a vertical axis, an axially extending bore, and a lateral production outlet extending from the bore through a sidewall of the tree transverse to the vertical axis;

a tree auxiliary passage extending through the sidewall of the tree and having a tree auxiliary port in the bore;

a tubing string;

a tubing hanger which lands sealingly in the bore and has a lateral flow passage extending from an axial flow passage, the axial flow passage being connected to the tubing string, the lateral flow passage aligning with the lateral production outlet of the tree;

a tubing hanger auxiliary passage extending through the tubing hanger, having a tubing hanger auxiliary port which aligns with the tree auxiliary port;

a seal at the auxiliary ports which seals the tree auxiliary passage to the tubing hanger auxiliary passage;

a downhole safety valve connected into the tubing string for selectively interrupting fluid flow through the tubing string; and a hydraulic line extending from the downhole safety valve to the tubing hanger auxiliary passage for receiving hydraulic fluid pressure from the tree auxiliary passage to actuate the downhole safety valve.

7. The well production assembly according to claim 6, wherein each of the auxiliary ports has an axis, and wherein the axes of the auxiliary ports coincide.

8. The well production assembly according to claim 6, wherein the seal comprises:

a tubular seal member located within the tubing hanger auxiliary port.

9. The well production assembly according to claim 6, wherein the seal comprises:

a tubular seal member located within the tubing hanger auxiliary port; and a seal surface surrounding the tree auxiliary port which is engaged sealingly by the seal member.

10. The well production assembly according to claim 6, wherein the tubing hanger auxiliary port comprises a cylindrical recess; and the seal comprises a tubular member located in the recess.

11. A well production assembly comprising in combination:

a tubular wellhead housing;

a string of casing supported in the wellhead housing and extending into the well;

a production tree mounted to the wellhead housing, having a vertical axis, an axially extending bore, and a lateral production outlet extending from the bore through a sidewall of the tree transverse to the vertical axis;

a tree auxiliary passage extending through the sidewall of the tree and having a tree auxiliary port in the bore;

a tubing string extending through the casing;

a tubing hanger which lands sealingly in the bore and has a lateral flow passage extending from an axial flow passage, the axial flow passage being connected to the tubing string, the lateral flow passage aligning with the lateral production outlet of the tree;

a tubing hanger auxiliary passage extending through the tubing hanger, having a tubing hanger auxiliary port which aligns with the tree auxiliary port; and a seal located in and surrounding the tubing hanger auxiliary port and sealing against the tree auxiliary port.

12. The well production assembly according to claim 11, wherein each of the auxiliary ports has an axis, and wherein the axes of the auxiliary ports coincide.

13. The well production assembly according to claim 11, wherein the seal comprises:

a tubular seal member located within a recess formed in the tubing hanger auxiliary port.

14. The well production assembly according to claim 11, further comprising:

a hydraulically actuated downhole safety valve connected into the tubing string for selectively interrupting fluid flow through the tubing string; and a hydraulic line extending from the downhole safety valve to the tubing hanger auxiliary passage for receiving hydraulic fluid pressure from the tree auxiliary passage.

* * * * *

UNITED STATES PATENT AND TRADEMARK OFFICE

CERTIFICATE OF CORRECTION

PATENT NO. : 6,119,773

DATED : 9/19/00

INVENTOR(S) : James A. Gariepy, Norman Brammer and Bret R. McConaughy

It is certified that error appears in the above-identified patent and that said Letters Patent is hereby corrected as shown below:

Column 1, line 65, after "possibility", delete "It"

Column 3, line 29, after "by" insert --a--

Signed and Sealed this

Fifteenth Day of May, 2001

Nicholas P. Godici

*Attest:*

NICHOLAS P. GODICI

*Attesting Officer*

*Acting Director of the United States Patent and Trademark Office*